United States Patent [19]

Maus

[11] 4,099,583

[45] Jul. 11, 1978

[54] GAS LIFT SYSTEM FOR MARINE DRILLING RISER

[75] Inventor: Leo Donald Maus, Houston, Tex.

[73] Assignee: Exxon Production Research Company, Houston, Tex.

[21] Appl. No.: 786,529

[22] Filed: Apr. 11, 1977

[51] Int. Cl.[2] ..... E21B 15/02; E21B 7/18

[52] U.S. Cl. ..... 175/7; 175/25; 175/69; 175/72

[58] Field of Search ..... 175/5, 7, 25, 38, 48, 175/50, 69, 72; 166/0.5; 299/17

[56] References Cited

U.S. PATENT DOCUMENTS

| | | | |
|---|---|---|---|
| 2,923,531 | 2/1960 | Bauer et al. | 175/7 |
| 3,434,550 | 3/1969 | Townsend, Jr. | 175/72 X |
| 3,465,817 | 9/1969 | Vincent | 175/7 X |
| 3,603,409 | 9/1971 | Watkins et al. | 175/7 |
| 3,815,673 | 6/1974 | Bruce et al. | 175/7 X |
| 3,911,740 | 10/1975 | Calhoun | 175/48 X |
| 3,955,411 | 5/1976 | Lawson, Jr. | 175/7 X |

*Primary Examiner*—Ernest R. Purser
*Assistant Examiner*—Richard E. Favreau
*Attorney, Agent, or Firm*—Salvatore J. Casamassima

[57] ABSTRACT

An improved offshore drilling method and apparatus are disclosed which are useful in preventing formation fracture caused by excessive hydrostatic pressure in a drilling riser. Gas is injected into the riser to provide the lift necessary to return the drilling fluid to the surface and to reduce the density of the drilling fluid. The rate of gas injection overlifts the drilling fluid to the extent that the pressure of the fluid is reduced to less than that of the seawater surrounding the riser. Seawater is permitted to flow into the lower end of the riser in response to the differential pressure between the drilling fluid and seawater so that the pressures of the drilling fluid and the seawater approximately equalize.

9 Claims, 4 Drawing Figures

GAS LIFT SYSTEM FOR MARINE DRILLING RISER

BACKGROUND OF THE INVENTION

1. Field of the Invention

This invention relates to an improved method and apparatus for drilling a well beneath a body of water. More particularly, the invention relates to a method and apparatus for maintaining a controlled hydrostatic pressure in a drilling riser.

2. Description of the Prior Art

In recent years the search for oil and natural gas has extended into deep waters overlying the continental shelves. In deep waters it is common practice to conduct drilling operations from floating vessels or from tall bottom-supported platforms. The floating vessel or platform is stationed over a wellsite and is equipped with a drill rig and associated equipment. To conduct drilling operations from a floating vessel or platform a large diameter riser pipe is employed which extends from the surface down to a subsea wellhead on the ocean floor. The drill string extends through the riser into blowout preventers positioned atop the wellhead. The riser pipe serves to guide the drill string and to provide a return conduit for circulating drilling fluids.

An important function performed by the drilling fluids is well control. The column of drilling fluid contained within the wellbore and the riser pipe exerts hydrostatic pressure on the subsurface formations which overcomes formation pressures and prevents the influx of formation fluids. However, if the column of drilling fluid exerts excessive hydrostatic pressure, the reverse problem can occur, i.e., the pressure of the fluid can exceed the natural pressure of one or more of the formations. Should this occur, the hydrostatic pressure of the drilling fluid could initiate and propogate a fracture in the formation, resulting in fluid loss to the formation, a condition known as "lost circulation". Excessive fluid loss to one formation can result in loss of well control in other formations being drilled, thereby greatly increasing the risk of a blowout.

The problem of lost circulation is particularly troublesome in deep waters where the fracture pressure of shallow formations, especially weakly consolidated sedimentary formations, does not significantly exceed that of the overlying column of seawater. A column of drilling fluid, normally weighted by drill cuttings and various additives such as bentonite, need be only slightly more dense than seawater to exceed the fracture pressure of these formations. Therefore, to minimize the possibility of lost circulation caused by formation fracture while maintaining adequate well control, it is necessary to control the hydrostatic pressure within the riser pipe.

There have been various approaches to controlling the hydrostatic pressure of the returning drilling fluid. One approach is to reduce the drill cuttings content of the drilling fluid in order to decrease the density of the drilling fluid. That has been done by increasing drilling fluid circulation rates or decreasing drill bit penetration rates. Each of these techniques is subject to certain difficulties. Decreasing the penetration rate requires additional expensive rig time to complete the drilling operation. This is particularly a problem offshore where drilling costs are several times more expensive than onshore. Increasing the circulation rate is also an undesirable approach since increased circulation requires additional pumping capacity and may lead to erosion of the well-bore.

Another approach in controlling hydrostatic pressure is to inject gas into the lower end of the riser. Gas injected into the riser intermingles with the returning drilling fluid and reduces the density of the fluid. An example of a gas injection system is disclosed in U.S. Pat. No. 3,815,673 (Bruce et al) wherein an inert gas is compressed, transmitted down a separate conduit, and injected at various points along the lower end of the drilling riser. The patent also discloses a control system responsive to the hydrostatic head of the drilling fluid which controls the rate of gas injection in the riser in order to maintain the hydrostatic pressure at a desired level. Such control systems, however, have the disadvantage of inherent time lags which can result in instability. This is especially a problem in very deep water where there may be significant delays from the time a control signal is initiated to the time a change in gas rate can produce a change in the pressure at the lower end of the riser pipe. As a result, the gas lift systems disclosed in the prior art do not have predictable responses with changing conditions.

SUMMARY OF THE INVENTION

The apparatus and method of the present invention permit control of the pressure of drilling fluid during offshore drilling operations. In accordance with the present invention, gas is injected into a drilling riser to provide the lift necessary to bring the drilling fluid to the surface and to reduce the density of the drilling fluid. The rate of gas injection is maintained so that the pressure of the drilling fluid at the bottom of the riser would be less than the hydrostatic pressure of the surrounding seawater if the drilling fluid were isolated from the seawater. However, seawater is permitted to flow into the lower end of the riser in response to the differential pressure between the drilling fluid and the seawater so that the hydrostatic pressures of the drilling fluid and the seawater become approximately equalized.

The apparatus of the present invention includes conventional offshore drilling components such as a riser pipe extending from a floating drilling vessel or platform to a subsea wellhead and a drill string extending through the riser pipe and into the borehole penetrating subterranean formations. Gas injection means such as gas supply conduits or injection lines are provided for introducing gas into the riser pipe. Valve means, such as a check valve, are positioned near the lower end of the riser to permit entry of seawater into the riser pipe. The apparatus can also include control means for regulating the rate of gas injection and the influx of seawater. Preferably, the drilling fluid used in the present invention is seawater or a saline drilling mud.

In accordance with the method of the present invention, a gas is injected into the riser pipe to intermingle and mix with the drilling fluid so that the density of the drilling fluid is sufficiently reduced to cause it to be positively displaced or "lifted" to the surface. The drilling fluid is slightly overlifted so that there exists a pressure differential between the drilling fluid within the riser and the surrounding body of seawater. Seawater is permitted to enter the lower end of the riser thereby reducing the pressure differential and approximately equalizing the pressure of the drilling fluid and the seawater. As a result, the pressure of the drilling fluid in the wellbore automatically stabilizes at a level which is below the fracture pressure of the surrounding formations. The system resists destabilization because the rate of influx of seawater automatically responds to changes in the density and circulating rate of the drilling fluid. Consequently, sophisticated control systems are not needed with the present invention.

DESCRIPTION OF THE PREFERRED EMBODIMENT

Figure 1:
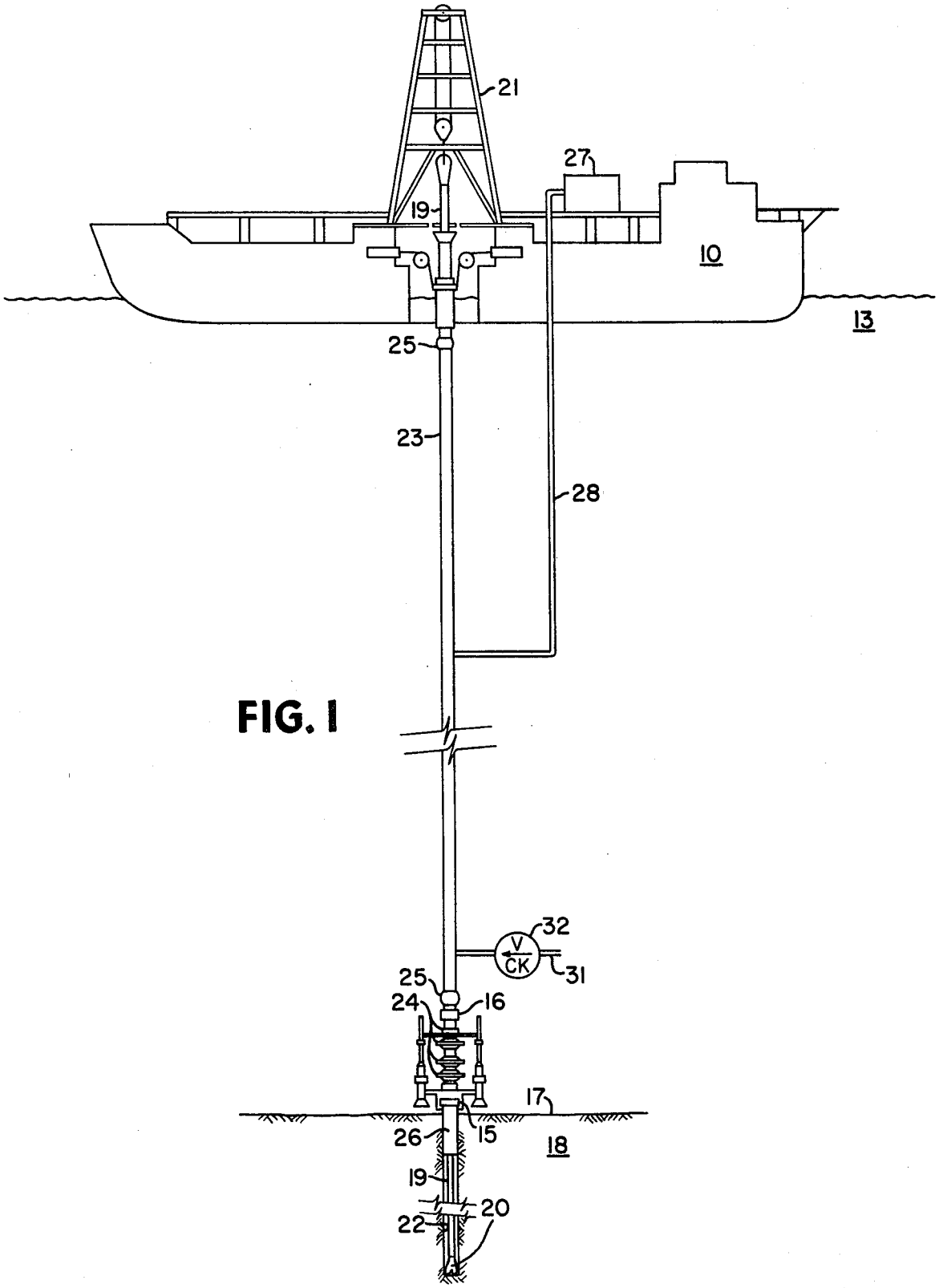
FIG. 1 is an elevation view, partially in section, of a floating drilling vessel provided with the apparatus of the present invention.

FIG. 1 shows a drilling vessel 10 floating on a body of water 13 and equipped with apparatus of the present invention to carry out the method of the present invention. A wellhead 15 is positioned on sea floor 17 which defines the upper surface or "mudline" of sedimentary formation 18. A drill string 19 and associated drill bit 20 are suspended from derrick 21 mounted on the vessel and extends to the bottom of wellbore 22. A length of structural casing pipe 26 extends from the wellhead to a depth of a few hundred feet into the sediments above wellbore 22. Concentrically receiving drill string 19 is riser pipe 23 which is positioned between the upper end of blowout preventer stack 24 and vessel 10. Located at each end of riser pipe 23 are ball joints 25.

Situated aboard vessel 10 is compressor 27 which provides high pressure gas for gas injection line 28. Injection line 28 extends from compressor 27 down part of the length of the riser and into riser pipe 23. Located at the lower end of riser pipe 23, above lower ball joint 25, is inlet 31 which permits entry of seawater into the riser pipe. The inlet can also be located on blowout preventer stack 24. Controlling the entry of seawater and preventing escape of drilling fluid from the riser is check valve 32

In order to control the pressure of the drilling fluid within riser pipe 23 compressed air is directed from compressor 27 through gas injection line 28 into the riser. The injected gas mixes with the drilling fluid to form a lightened three phase fluid consisting of gas, drilling fluids and drill cuttings. The gasified fluid has a density substantially less than the original drilling fluid and therefore exerts a lower hydrostatic pressure on sedimentary formation 18. The gas also provides lift to the drilling fluid and assists in returning it up through the riser to surface vessel 10.

Ideally, the density of the drilling fluid should be approximately the same as the surrounding sea water. Normally, density control is difficult to achieve and usually requires a control system which closely regulates the rate of gas injection and the circulatiion of drilling fluid. The present invention, however, provides a simple control system utilizing external sea water as a pressure balancing fluid that gives almost instantaneous control.

For most drilling operations, seawater can be used as the drilling fluid through approximately the first few thousand feet of rock. Conventional "mud" based drilling fluids are needed only at greater depths where the well control provided by weighted drilling muds are necessary. Therefore, in drilling through shallow formations a seawater based drilling fluid can be used. Obviously, diluting such a drilling fluid with sea water from outside the riser presents no problem.

In the present invention check valve 32 is opened, permitting the influx of seawater into riser pipe 23. If the drilling fluid in the riser pipe is slightly overlifted by injecting more gas than is necessary to return the drilling fluid to the surface there will be a net pressure differential between the drilling fluid and surrounding seawater. This pressure differential will register across valve 32 and will draw seawater into the riser pipe through inlet 31. If valve 32 and inlet line 31 are sufficiently large the pressure differential will tend to decrease until the pressure within the riser and the pressure of the seawater substantially equalize. The system will tend to be self controlling, that is, the flow of seawater into the riser will automatically adjust to compensate for changes in the rate of gas injection, density of the drilling fluid, or circulation rate of the drilling fluid, thereby maintaining the hydrostatic pressure inside the riser pipe almost equal to the pressure of the surrounding seawater. The system is therefore self stabilizing. However, in the event the pressure within the riser exceeds the external pressure of the surrounding seawater, check valve 31 will prevent reverse flow of drilling fluid into the sea, thereby preventing any contamination of the sea with drill cuttings or mud additives.

Figure 2A:
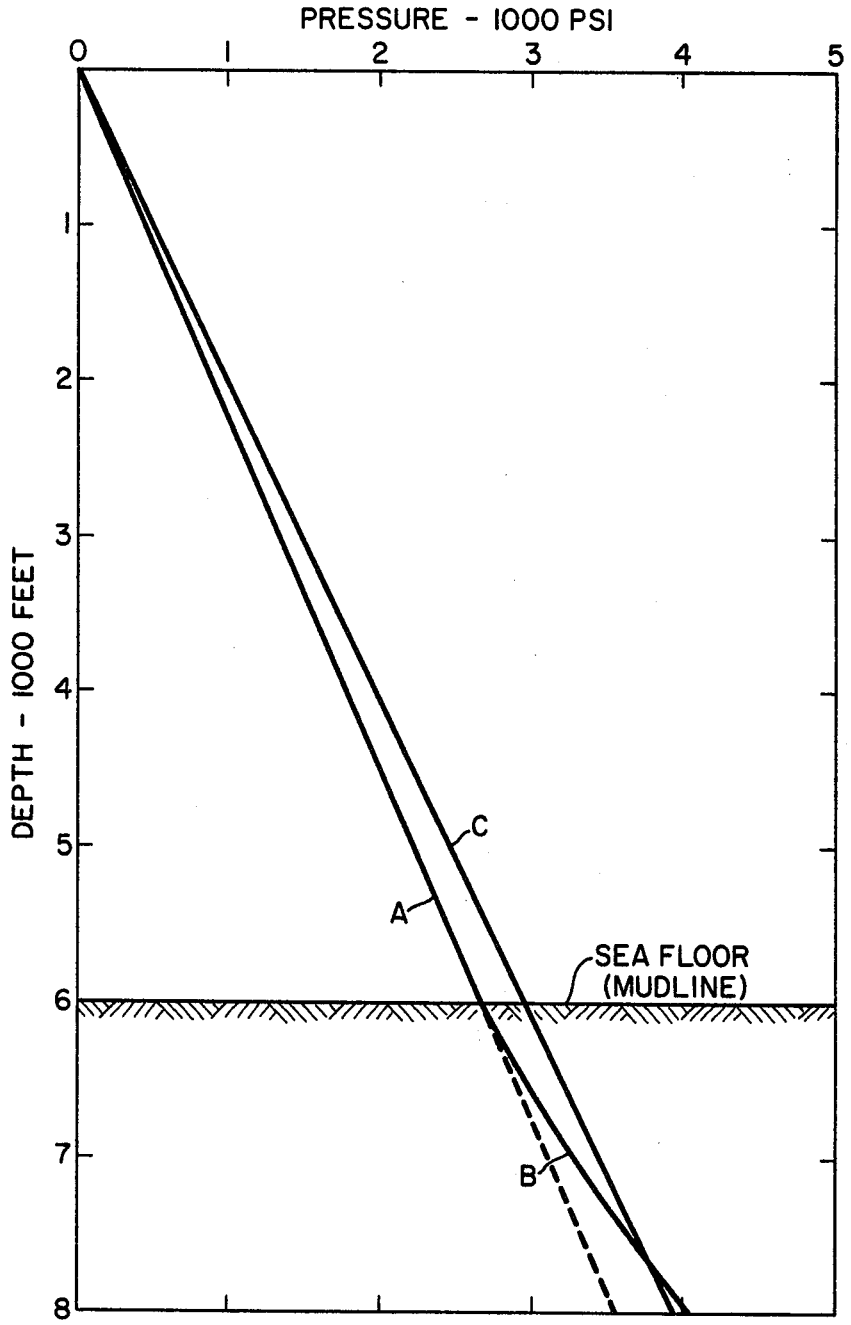
FIGS. 2(A) and 2(B) are plots of pressure versus depth which illustrate and compare the performance of the present invention with conventional drilling practices.
Figure 2B:
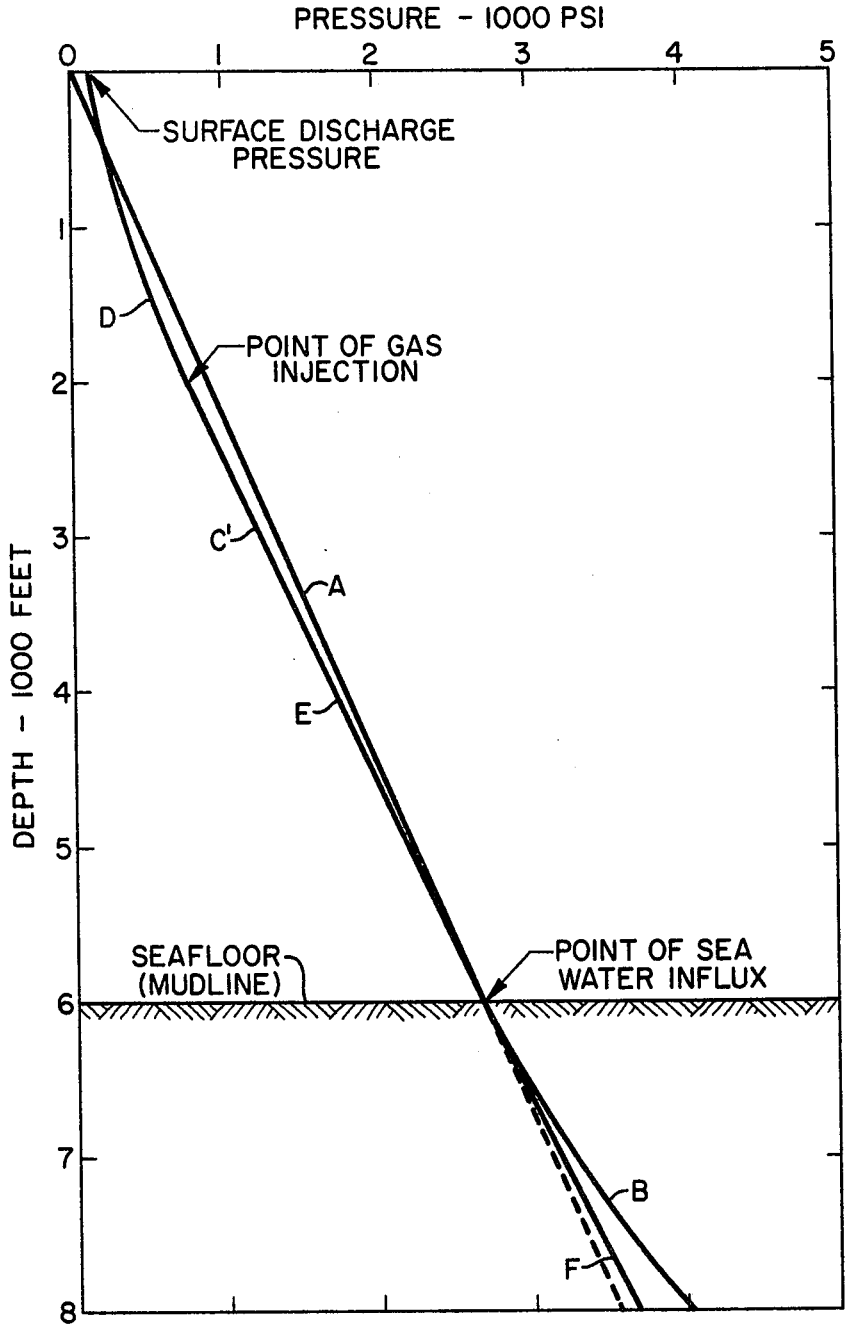

The avoidance of formation fracture by the method and apparatus of the present invention is illustrated in FIGS. 2(A) and 2(B) which compares the pressure relationships involved in drilling an offshore well with and without the present invention. In FIG. 2(A), curve A relates hydrostatic pressure versus depth for seawater having a pressure gradient of 0.444 psi/ft (or about 8.5 pounds per gallon). This curve is shown extending from the sea surface to the sea floor or mudline which has arbitrarily been chosen to be 6000 feet below the surface. Extending below the sea floor is curve B which represents the fracture pressure of the subterranean formations beneath the sea. For normally consolidated sediments, the fracture pressure is approximately equal to the seawater pressure at the sea floor and increases with depth below the sea floor at a gradient greater than that of seawater (the seawater gradient being shown by the dotted line extension of curve A).

Corresponding to curves A and B is curve C which relates hydrostatic pressure versus depth for drilling mud inside a riser pipe and wellbore. The curve is for a typical drilling mud having a density of 9.5 pounds per gallon (including drill cuttings) thereby giving it a pressure gradient of 0.494 psi/ft. It can be readily seen that until a total depth of about 7700 feet (1700 feet below the sea floor) the hydrostatic wellbore pressure of the drilling mud exceeds the fracture pressure of the formation. The point of intersection of curves B and C represents the point below which the formation can be safely drilled with the 9.5 ppg mud. However, except for the first few hundred feet below the mudline which are protected by structural casing, the entire interval from beneath the structural casing to a depth of 1700 feet below the sea floor would be in danger of formation fracture and lost returns and could not be safely drilled with conventional drilling practices using 9.5 pound per gallon mud.

FIG. 2(B) shows how the present invention permits safe drilling through upper level sediments without the danger of formation fracture. As before, curves A and B respectively represent seawater pressure and fracture pressure versus depth. Curve C' represents the hydrostatic pressure profile of the drilling fluid in the riser pipe and wellbore. Curve C' is nonlinear and basically consists of three separate segments which are labeled D, E and F.

As indicated, gas is injected into the riser pipe at a depth of about 2000 feet. Segment D of Curve C' represents the pressure profile of the fluid in the riser above the point of gas injection, the fluid consisting of a mixture of drilling mud, sea water and gas. The gas injected into the fluid substantially reduces the density of the fluid, thereby shifting the pressure profile to the left of the sea water profile (Curve A). The fluid in the riser is thus gas lifted to the surface from a depth of 2000 feet where it is discharged to a separator at some positive pressure.

Segment E of Curve C' is the pressure profile from below the point of gas injection to the sea floor. The fluid in the riser at this point consists of a mixture of drilling mud (9.5 ppg) and seawater (8.5 ppg), the seawater coming in as a result of the influx into the riser across the check valve positioned at the lower end of the riser. The influx of seawater not only stabilizes the system, but also reduces the overall density of the fluid in the riser. Consequently, Curve C' slopes more steeply than Curve C in FIG. 2(A).

Segment F of Curve C' represents the pressure profile of the drilling mud in the borehole. It has a slope slightly less steep than segment E since the drilling mud at this point has not been mixed with lower density seawater. However, the gas injection and seawater influx offsets the riser and wellbore pressure sufficiently so that at the depth of the sea floor the mud pressure is approximately equal to that of the surrounding seawater. Therefore, the pressure of the mud within the wellbore will always be (as shown in FIG. 2(B)) less than the fracture pressure of the formation.

Figure 3:
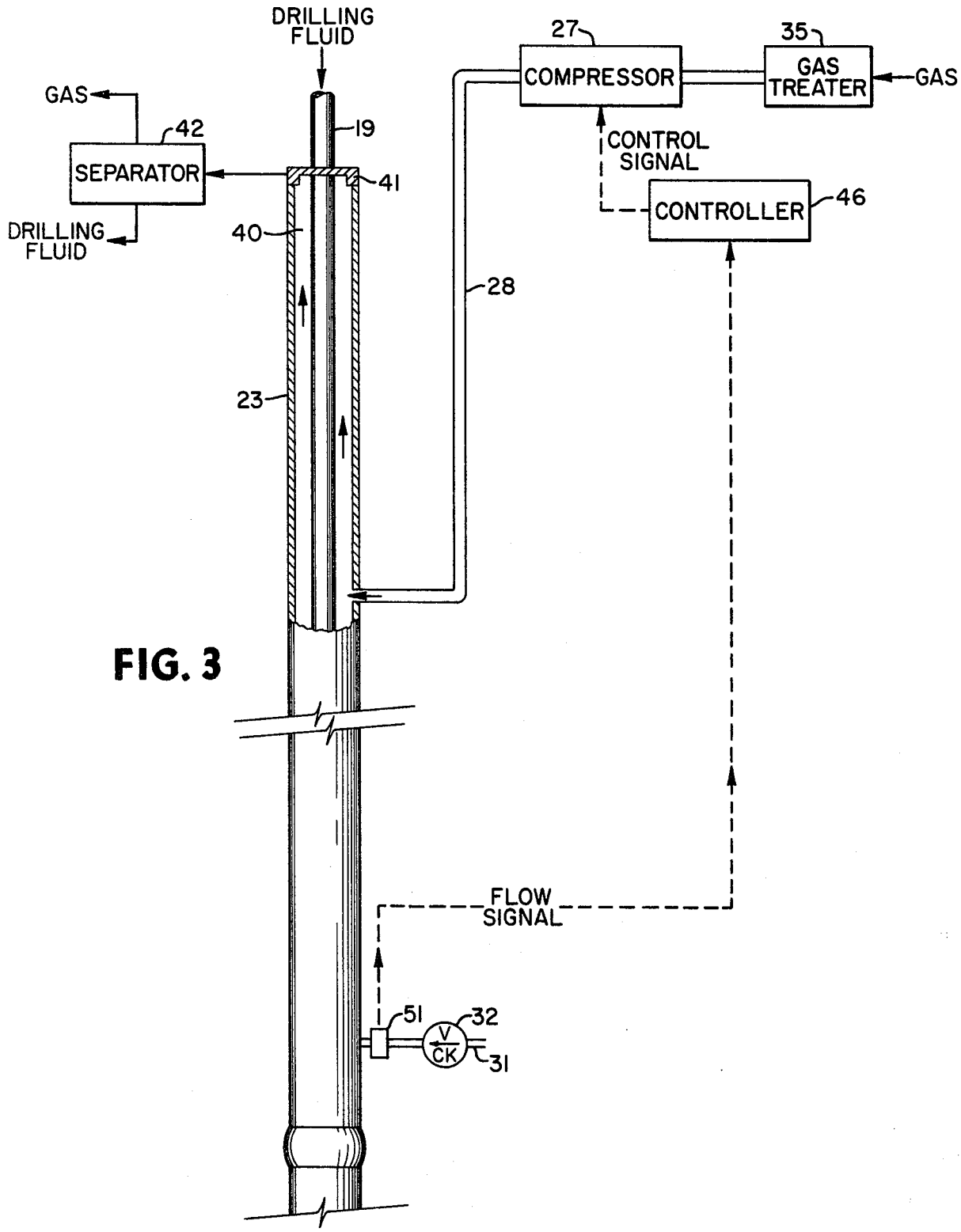
FIG. 3 is a schematic diagram, partially in section, of the apparatus of the present invention including a control system for regulating the hydrostatic pressure of the drilling fluid in a marine riser.

FIG. 3 schematically depicts in more detail the gas lift system of the present invention and a simplified control design that can be used with the lift system. Gas after being routed through a gas treater 35 is fed into compressor 27. The gas used can be air or an inert gas. If it is desirable to minimize the chance of corroding valves or tubulars coming in contact with the gas, an inert gas such as nitrogen is preferred. A frequently used inert gas is the exhaust gas generated by the internal combustion engines aboard the drill ship which provide the power to run the equipment associated with drilling operations. Normally, the gas undergoes several treatment stages before being sent to compressor 27.

Drilling fluid (preferably seawater) is circulated downwardly through drill pipe 19 and returns through riser pipe 23. Compressed gas injected into the riser pipe mixes with the drilling fluid and drill cuttings to form a lightened fluid indicated by numeral 40. The lightened drilling fluid flows upwardly to rotating drilling head 41 which diverts the gas-liquid mixture away from the drill floor. Both gas and drilling fluid are diverted into separator 42 where the gas constituents are removed from the drilling fluid. The drilling fluid may then be treated by a conventional mud treatment system to remove drill cuttings. If preferred, both drilling fluid and gas can be recycled into the system once separated.

As noted prevously, the degree of control over the lift system of the present invention is maximized (while minimizing complexity) by the influx of seawater through inlet 31. With a constant overlift being provided by gas injection line 28, there will be a continuous flow of seawater into riser pipe 23 through check valve 32. The rate of flow of seawater into the riser will automatically compensate for changes in drilling fluid density and circulating rate provided drilling fluid is being sufficiently overlifted to reduce the pressure of the drilling fluid to below that of the surrounding seawater. Nevertheless, it is desirable that influx of seawater be minimized since a volume of drilling fluid equal to the volume of sea water entering the riser must be discharged at the surface.

As shown in FIG. 3, control over seawater influx can be maintained by a simple control loop. Flowmeter 51 measures the rate at which sea water enters riser pipe 23 from valve 32 and transmits a flow signal by means of electrical conductor 52 to controller 46. Controller 46 returns a control signal, responsive to the flow signal, to adjust the gas output of compressor 27. The rate of gas injection could then be altered to keep the degree of gas lift to a level which provides a positive, yet low, influx of seawater through check valve 32. The monitoring of seawater influx also provides a useful indication of well kicks or lost circulation. Changes in drilling fluid circulation rate due to kicks or lost circulation would be reflected by approximately equal and opposite changes in seawater influx thereby giving a timely warning of well control problems.

Seawater influx provided by the present invention is also useful in maintaining well control when drilling fluid circulation must be stopped. For example, when it is necessary to stop fluid circulation for a few minutes to connect a new joint of drill pipe, seawater influx will automatically increase to compensate for the cessation of flow of drilling fluid. In this manner circulation can be maintained through the riser pipe thus avoiding momentary interruption of the gas lift system and insuring a quick return to steady state operations once drilling fluid circulation resumes.

It should be apparent from the foregoing that the apparatus and method of the present invention offer significant advantages over pressure control systems for marine risers previously known to the art. It will be appreciated that while the present invention has been primarily described with regard to the foregoing embodiments, it should be understood that several variations and modifications may be made in the embodiments described herein without departing from the broad inventive concept disclosed herein.

What is claimed is:

1. In an apparatus for drilling a well through subterranean formations beneath a body of water from the surface of said body of water, said apparatus comprising a riser pipe extends from the surface to a subsea wellhead and a drill string which passes through said riser pipe and into a borehole under the body of water, the improvement comprising:

gas injection means for lifting drilling fluid in said riser pipe to the surface to reduce the pressure of the drilling fluid so that there exists a differential pressure between the drilling fluid and said body of water; and valve means positioned near the lower end of said riser pipe for providing an influx of seawater into said riser pipe in response to said differential pressure so that the pressures of the drilling fluid and said body of water approximately equalize while the pressure of the drilling fluid in the borehole stabilizes at a level which is below the fracture pressure of the formations.

2. The apparatus of claim 1 wherein said valve means is a check valve which permits seawater to enter said riser pipe but which does not permit drilling fluid to escape from said riser pipe.

3. The apparatus of claim 1 wherein control means are provided for regulating the rate of injection of gas and the influx of seawater into said riser pipe.

4. The apparatus of claim 1 wherein said gas injection means includes a gas supply conduit which extends down from the surface vessel to said riser pipe.

5. The apparatus of claim 4 wherein said injected gas is an inert gas.

6. In a method of drilling a well through subterranean formations beneath a body of water from the surface of said body of water wherein a riser pipe extends from the surface to a subsea wellhead and wherein a drill string passes through said riser pipe and into a borehold under the body of water, the improvement comprising:

injecting gas into said riser pipe to lift drilling fluid in said riser pipe to the surface and to reduce the pressure of the drilling fluid so that there exists a differential pressure between the drilling fluid and said body of water; and permitting seawater to flow into the lower end of said riser pipe in response to said differential pressure so that the pressures of the drilling fluid and said body of water approximately equalize while the pressure of the drilling fluid in the borehole stabilizes at a level which is below the fracture pressure of the formations.

7. The method of claim 6 wherein said injected gas is an inert gas.

8. The method of claim 6 wherein said gas is injected by means of a gas supply conduit which extends down from the surface vessel to said riser pipe.

9. The method of claim 6 wherein said drilling fluid is seawater.

* * * * *